US005918490A

United States Patent [19]

Lion

[11] Patent Number: 5,918,490

[45] Date of Patent: Jul. 6, 1999

[54] COMBINATION GOLF CLUB LOCK AND GOLF CLUB HOLDER

[76] Inventor: Ronald K. Lion, 375 Summit Rd., Watsonville, Calif. 95076

[21] Appl. No.: 09/015,046

[22] Filed: Jan. 28, 1998

[51] Int. Cl.[6] ..... E05B 69/00

[52] U.S. Cl. ..... 70/58; 70/18; 70/30; 70/49; 211/70.2; 206/315.3

[58] Field of Search ..... 70/58, 18, 30, 70/49; 206/315.3, 315.6; 211/70.2

[56] References Cited

U.S. PATENT DOCUMENTS

| | | | |
|---|---|---|---|
| 1,717,959 | 6/1929 | Cauffman | 206/315.6 |
| 4,057,983 | 11/1977 | Morgan | 70/18 |
| 4,863,019 | 9/1989 | Lewis et al. | 206/315.3 |
| 4,979,382 | 12/1990 | Perry | 70/58 |
| 5,004,100 | 4/1991 | Smith | 206/315.2 |
| 5,267,660 | 12/1993 | Kwon | 211/70.2 |
| 5,524,753 | 6/1996 | Murphy | 206/315.6 |
| 5,531,083 | 7/1996 | Franck, III et al. | 70/58 |
| 5,560,485 | 10/1996 | O'Hara, Jr. | 206/315.4 |
| 5,582,043 | 12/1996 | McCue et al. | 70/58 |
| 5,590,772 | 1/1997 | Schuhlen et al. | 206/315.3 |
| 5,636,734 | 6/1997 | Smith | 206/315.2 |
| 5,636,735 | 6/1997 | Stusek | 206/315.6 |

*Primary Examiner*—Steven Meyers
*Assistant Examiner*—Clifford B Vaterlaus
*Attorney, Agent, or Firm*—Jeffrey A. Hall

[57] ABSTRACT

A golf club locking device and golf club holder assembly is provided, comprising an upper housing element having a substantially circular configuration, an outer locking knob coupled to the upper housing element, an inner locking coupler operably linked to the outer locking knob, and a locking plate secured to the inner locking coupler. A key cylinder is communicatively linked to the locking plate and a rubber bumper for holding golf clubs within the assembly is secured to the locking plate. A cable locking mechanism for locking the assembly to any object or to a golf bag is secured to a cable anchor plate and locking cable, and a lower housing element is configured to be adapted secured to the upper housing element.

10 Claims, 4 Drawing Sheets

COMBINATION GOLF CLUB LOCK AND GOLF CLUB HOLDER

BACKGROUND OF THE INVENTION

1. Field of Invention

This invention relates to locking and holding devices for golf clubs, and more particularly to locking and holding devices for golf clubs in combination with a golf club bag.

2. Description of the Related Art

The protection of golf clubs from theft is a significant concern to golf players and golf club owners. As the cost of golf clubs and accessories rise it is not uncommon for a typical golfer to have a significant investment in the contents of his or her golf bag, including golf clubs, wedges, and fairway woods. It is also not uncommon for golfers to leave their bags unattended for significant periods of time while in the club house, locker room, restaurant, and the like.

Various golf bag protection devices have been proposed and implemented. Some for example, include two or more arms for fingers through which golf clubs protrude. The arms are closed at one end and then secured with a key or combination lock. Such devices are not integrally formed with the golf bag nor are such locks integral with the locking devices.

Another type of golf bag locking devices is seen, for example, in U.S. Pat. Nos. 5,524,753 issued to Thomas Murphy, Jun. 11, 1996 and 5,636,735 issued to Richard A Stusek, Jun. 10, 1997. Such devices use a set of plates having slots or apertures therein to hold golf clubs and a locking mechanism to lock the clubs to the golf bags. This type of golf bag security device is configured either as part of the bag or are fastened on to the bag by means of screws for other fasteners. Once these locks are in place then clubs are fed through openings which decrease in dimension as the lock is operated thereby enclosing the golf club within the opening. Such limitations are undoubtedly a reason such golf club security devices have not received widespread acceptance.

Accordingly, it is the primary object of this invention to provide a combination golf club lock and golf club holder which provides docking stations that each golf club can snap or insert into. The individual docking stations hold the clubs by means of a rubber bumper that holds the clubs within a lock and also protects the shafts from any abrasion. Once the clubs have been inserted into these docking stations then the simple rotation of a locking knob rotates a plate across the opening of these docking stations closing off the opening and locking the clubs within the device. In contrast to prior golf club security devices, the present invention holds and secures a golf club while maintaining the size of the club docking stations, while prior devices have locked a golf club by decreasing the size of the openings into which the golf club is locked. Further, the present golf club lock and holder can accommodate most of the slot patterns that are used by golf bag manufactures today. This allows for a generic club configuration and thereby a convenient hand held "easy on/easy off" type of lock that can be used on most golf club bags. In addition, the size and weight of the lock is such that it can be easily carried in the golf bag or other convenient location.

Additional objects and advantages of the invention will be set forth in the description which follows, and in part will be obvious from the description, or may be learned by practice of the invention. The objects and advantages of the invention may be realized and obtained by means of the instrumentality's and combinations particularly pointed out in the appended claims.

SUMMARY OF THE INVENTION

To achieve the foregoing objects, and in accordance with the purpose of the invention as embodied and broadly described herein, a golf club locking device and golf club holder assembly is provided, comprising an upper housing element having a substantially circular configuration, an outer locking knob coupled to the upper housing element, an inner locking coupler operably linked to the outer locking knob, and a locking plate secured to the inner locking coupler. A key cylinder is communicatively linked to the locking plate and a rubber bumper for holding golf clubs within the assembly and is secured to the locking plate. A cable locking mechanism for locking the assembly is secured to a cable anchor plate and locking cable, and a lower housing element is configured to be adapted and secured to the upper housing element.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DESCRIPTION OF THE PREFERRED EMBODIMENTS

Figure 1:
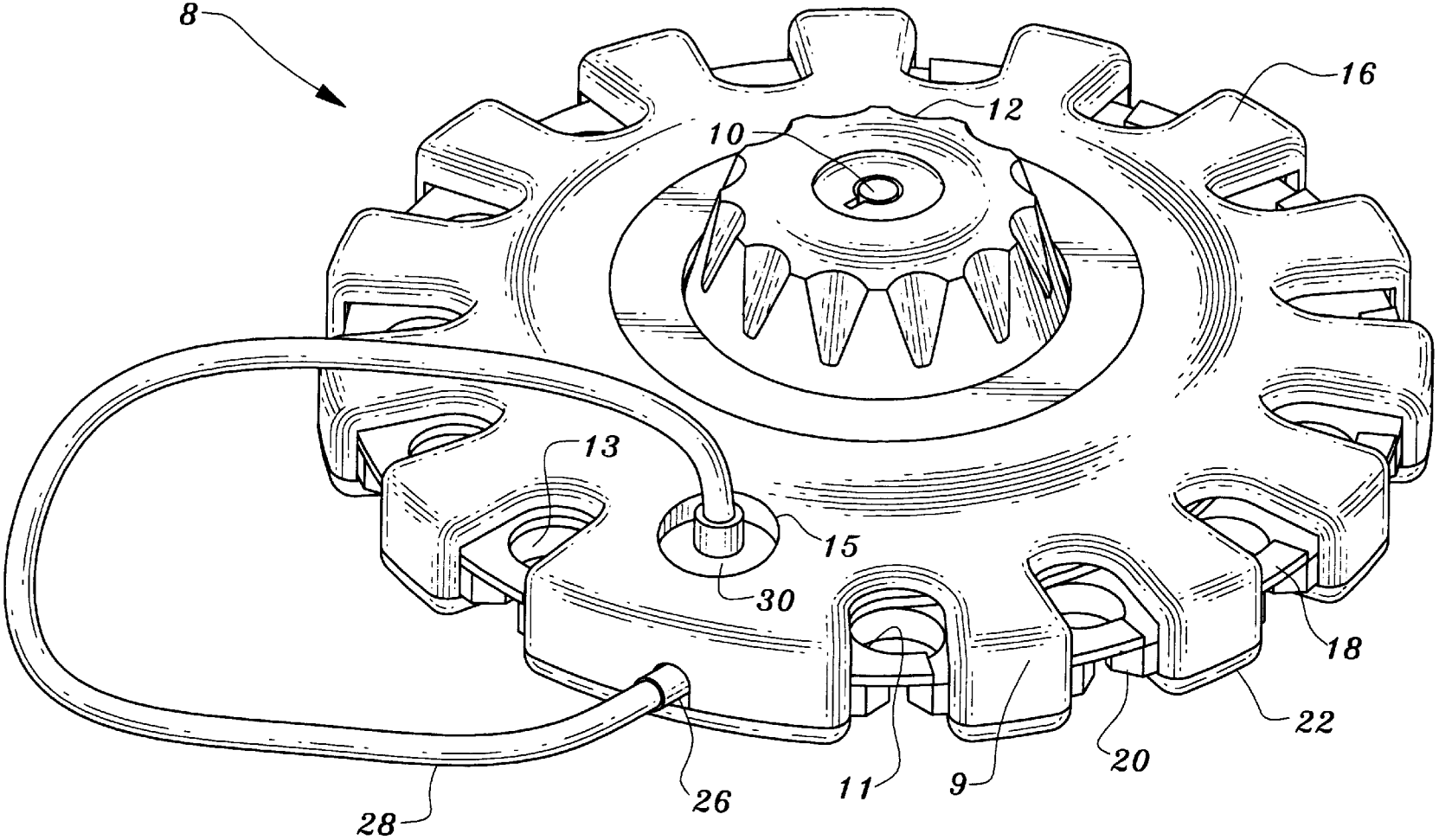
FIG. 1 is a top perspective view of the combination golf club lock and golf club holder, according to the invention.

Reference will now be made in detail to the present preferred embodiments of the invention as illustrated in the accompanying drawings.

In accordance with the present invention, there is provided in a preferred embodiment of the invention, a golf club locking device and golf club holder assembly is provided, comprising an upper housing element having a substantially circular configuration, an outer locking knob coupled to the upper housing element, an inner locking coupler operably linked to the outer locking knob, and a locking plate secured to the inner locking coupler. A key cylinder is communicatively linked to the locking plate and a rubber bumper for holding golf clubs within the assembly is secured to the locking plate. A cable locking mechanism for locking the assembly is secured to a cable anchor plate and locking cable, and a lower housing element is configured to be adapted secured to the upper housing element.

In accordance with the present invention, there is also provided an improved golf club locking device, comprising an upper housing element, an outer locking knob operably coupled to the upper housing element and an inner locking coupler operably being substantially circular in configuration and secured to the outer locking knob. A locking plate is secured to the inner locking coupler and a key cylinder is secured to the locking plate. A rubber bumper for holding golf clubs within the golf club locking device is secured to the locking plate and cable locking means are secured at one end to a cable anchor plate. A substantially circular lower housing element is configured to be adapted secured to the upper housing element.

In FIGS. 1–6 the combination golf club locking device and golf club holder assembly 8 is shown according to a preferred embodiment of the invention. A substantially circular upper housing 16 is provided The primary function of the upper housing 16 is to enclose the assembly 8 and provide structural rigidity. In addition to containing outer knob 12 the upper housing 16 acts as a retainer for the rubber bumper 20 and metal locking plate 18, in effect sandwiching and holding these parts together. Upper housing 16 also preferably contains the ports or openings 9 for the golf clubs to be inserted in to and an aperture 15 for anchor pin 30. Although the clubs are retained by the rubber bumper 20, the upper housing 16 provides the structural integrity for these openings. Housing 16 is preferably composed of a durable resilient material such as plastic or rubber, but may be otherwise.

Figure 2:
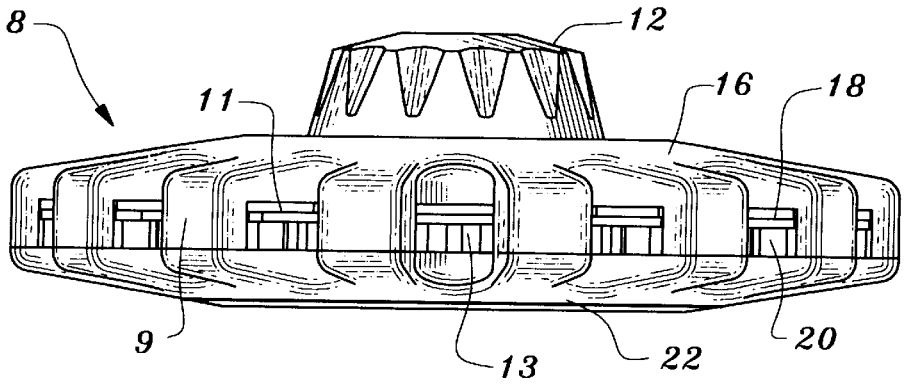
FIG. 2 is a side view of such combination golf club lock and golf club holder, according to the invention.
Figure 4:
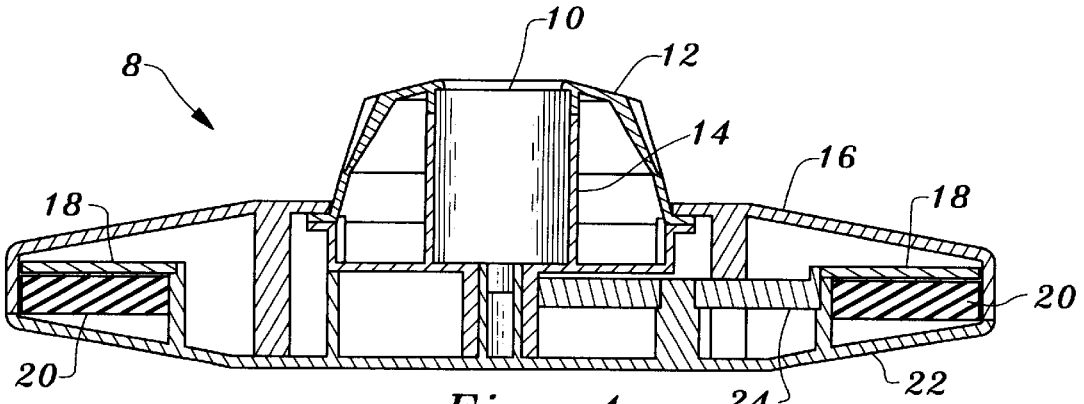
FIG. 4 is a sectional view of such combination golf club lock and golf club holder, according to the invention.
Figure 5:
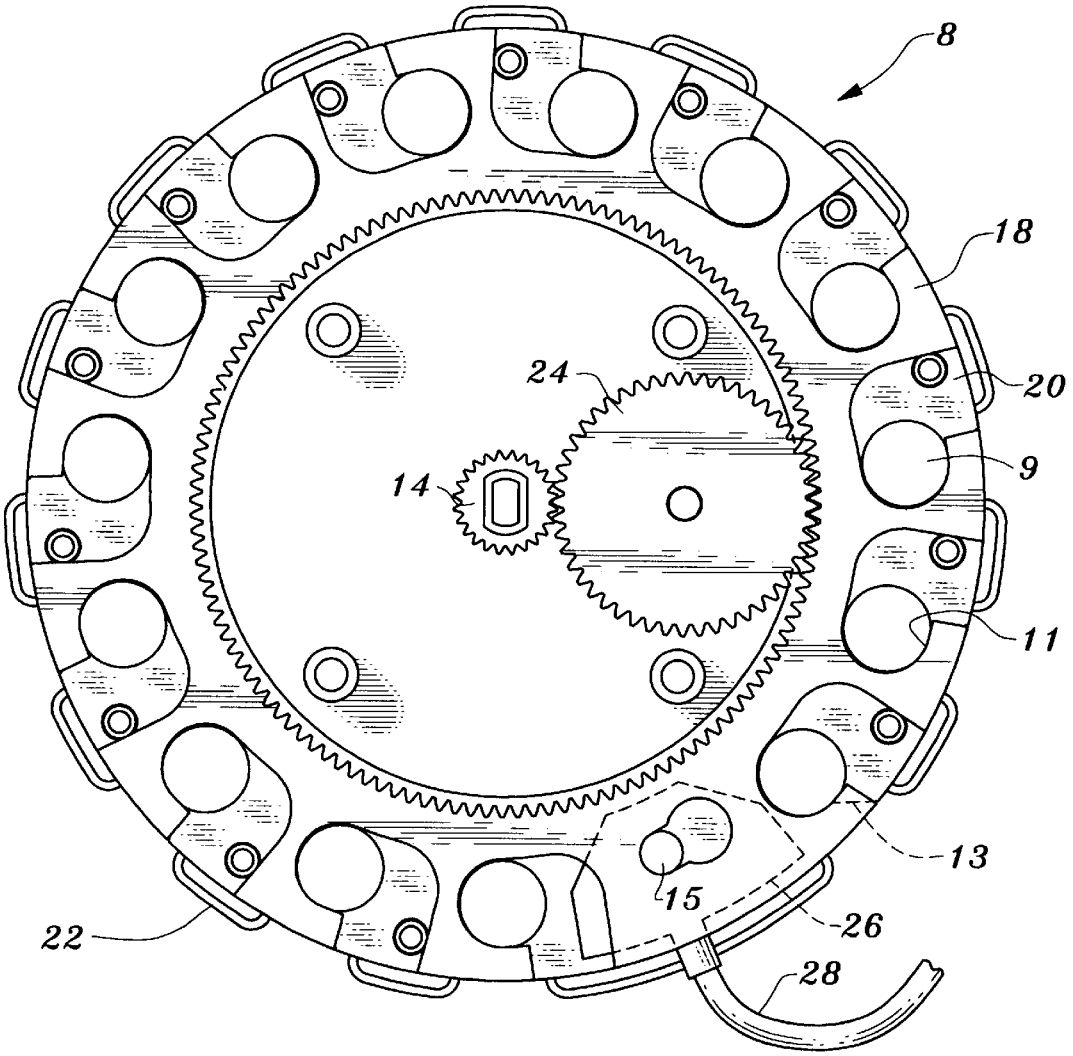
FIG. 5 is a is a top plan view of such combination golf club lock and golf club holder showing locking plate rotation, according to the invention.
Figure 6:
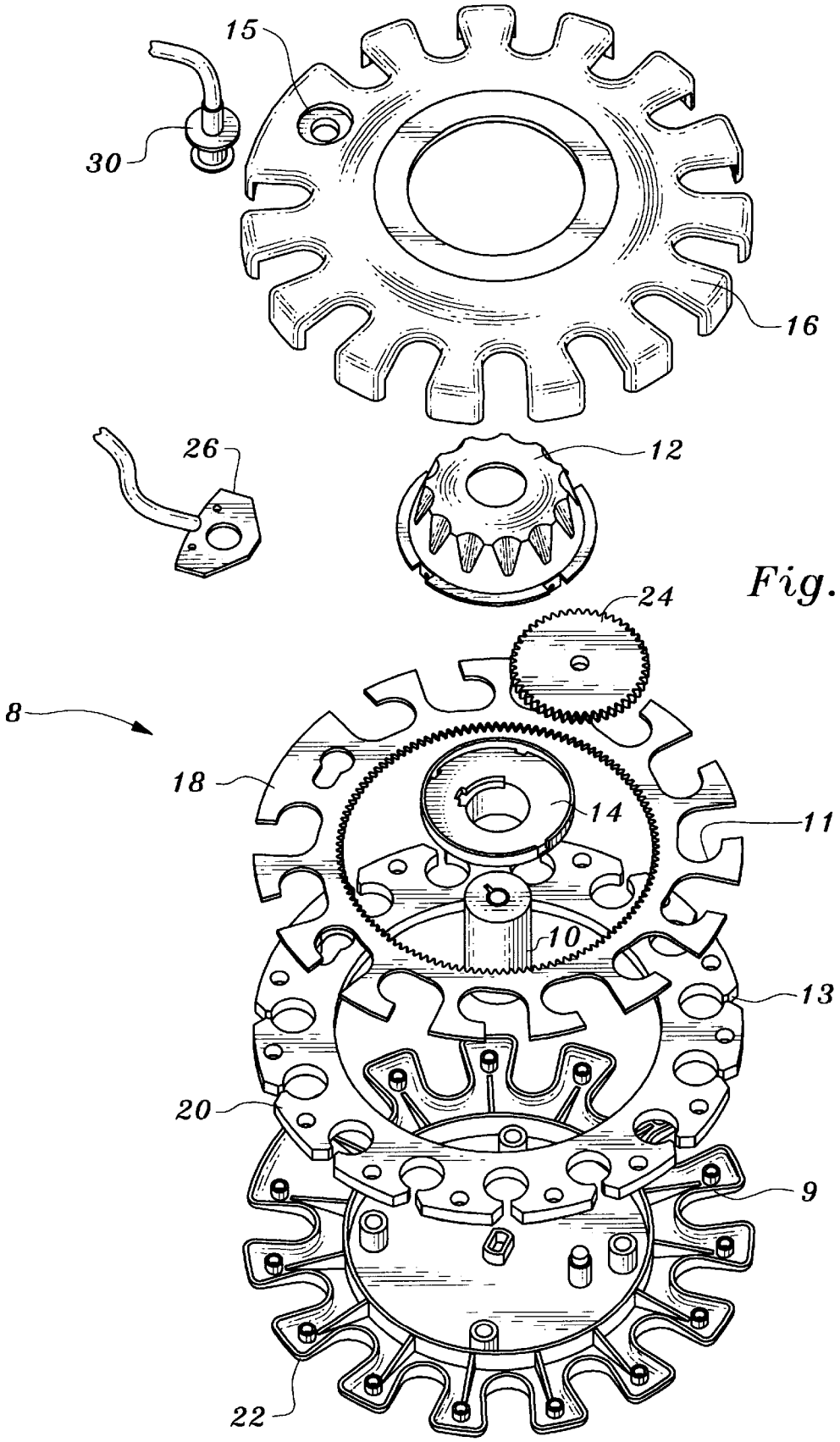
FIG. 6 is an exploded view of such combination golf club lock and golf club holder, according to the invention.

A lower housing 22, best seen in FIGS. 2, 4, and 6, is the bottom portion of the structure which encloses and sandwiches the rubber bumper 20 and metal locking plate 18. The lower housing 22 with apertures 9 provides the lower half of the structure, which encloses the whole assembly 8. Retaining screws 32 are inserted through the lower housing 22 into the upper housing 16 which hold the entire assembly 8 together. The lower housing 22 also contains bosses which hold gears 14 and 24, seen in FIG. 6, and key cylinder 10 in place and locates them within the mechanism. Housing retainer screws preferably comprise four retainer screws 32 which sandwich all parts together and fasten the lower housing 22 to the upper housing 16.

Figure 3:
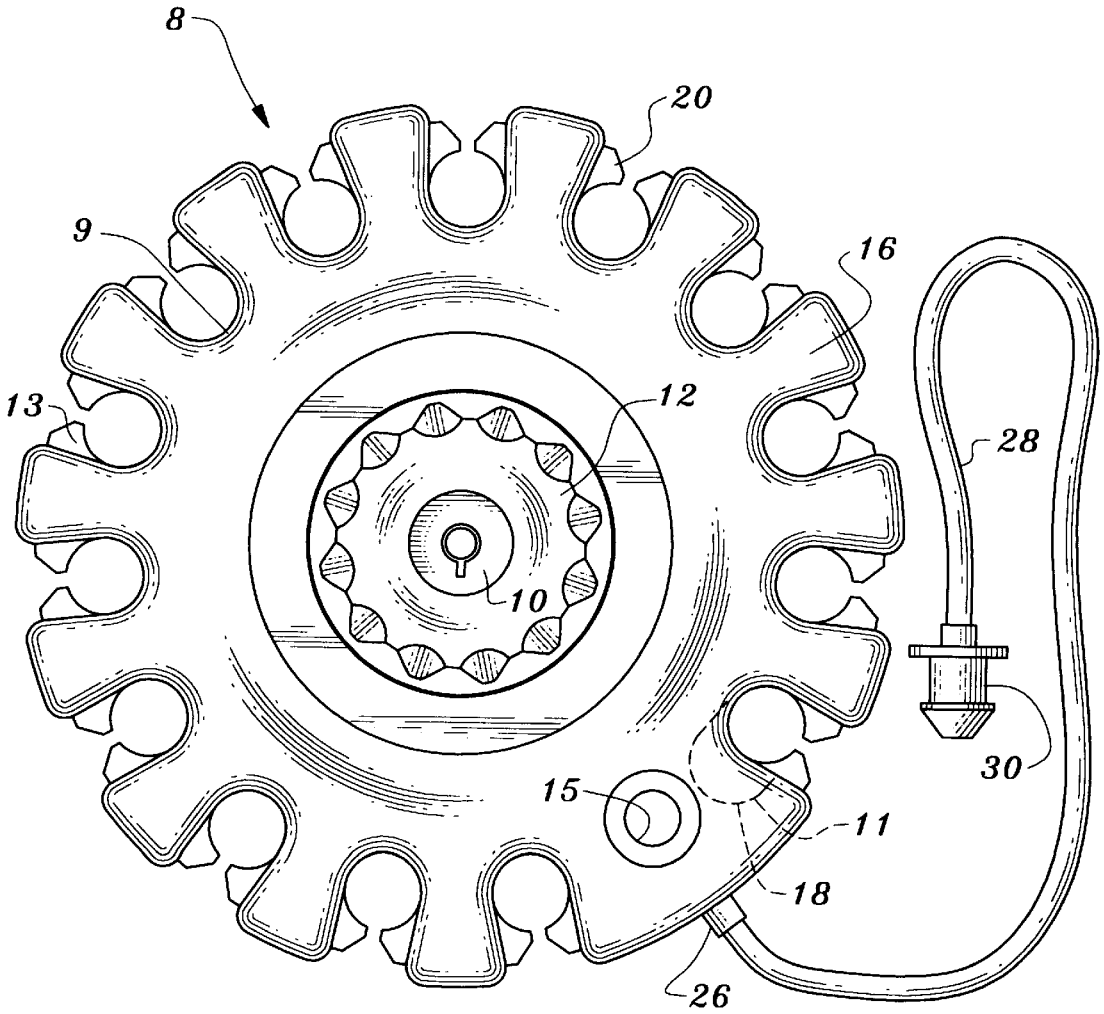
FIG. 3 is a top plan view of such combination golf club lock and golf club holder, according to the invention.

A key cylinder 10, best seen in FIGS. 3, 4, and 6 provides a locking mechanism that contains a paul that is actuated by a key. When the key is rotated in to the locked position the paul is thrown which prevents rotation of the outer locking knob 12, inner locking coupler 14 and metal locking plate 18.

An outer locking knob 12 best seen in FIGS. 1, 2, 4, and 6 is provided which couples with inner locking coupler 14 such that when the outer locking knob 12 is rotated, it rotates the inner locking coupler 14 which in turn rotates the large gear 24 which rotates the metal locking plate 18. Outer locking knob 12 retains the key cylinder 10 and is retained by the upper housing 16. There are detents in the interface between the outer locking knob 12 and the upper housing 16 such that when the outer locking knob 12 is either in a locked or unlocked position it is secured there by means of these detents.

The inner locking coupler 14 seen in FIGS. 4 and 6 retains the key cylinder 10 and provides the interface between the outer locking knob 12 and the large gear 24 and metal locking plate 18. The inner locking coupler 14 has a small gear designed in to it so as to fit with the large gear 24. The ratio of the small gear on the inner locking coupler 14 with the ratio of the large gear 24 is such so as to increase the mechanical advantage or torque on the metal locking plate 18. In addition, the ratio of the small gear on the inner locking coupler 14 with the large gear 24 is used to increase the degrees of rotation of the outer locking knob 12 to rotate the metal locking plate 18 in to a locked position.

As seen in FIG. 6, metal locking plate 18 with ports or apertures 11 is the locking mechanism that preferably constrains the golf clubs within each of its port openings, fifteeen in the preferred embodiment. The metal locking plate 18 interfaces with the outer locking knob 12 by means of two gears. When the outer knob is rotated this rotation is translated through these gears which increase the torque applied to the metal locking plate 18. The metal locking plate 18 rotates across the individual golf club port openings closing these openings off and locking the golf clubs in place. Each golf club port 11 is designed such that when the metal locking plate 18 is in the locked position it completes the circular opening and in effect shuts it off. One port 11 of the metal locking plate 18 is preferably sized differently than the other ports and corresponds to aperture 15 in the upper housing and lower housing. It contains the same dimension hole as the other ports but its function is different. Aperture 15 is not a port but an actual hole designed to accept an anchor pin 30 which is connected to a cable 28. Anchor pin 30 is designed such that when the pin is inserted in to the hole of the upper housing 16 and through the rubber bumper 20 and metal plate 18, it is locked in to the assembly 8 by means of a slot in the metal plate 18 that narrows down the opening when the metal plate 18 is rotated in to the locked position thereby locking the anchor pin 30 in to the assembly 8.

Rubber bumper 20, as seen in FIGS. 1–6, has two principal functions. First, it constrains the golf clubs within the assembly 8 so that they are held in place prior to the metal plate 18 being rotated in to the locked position, and it protects the clubs from coming in contact with either the plastic or rubber housing 16, 22 or metal locking plate 18. This protection from contact with either the housing 16, 22 or the metal locking plate 18 is meant to guard each club from scratching or other abrasion that may occur from contact with these members. When each club is inserted into a port 13 of the lock the rubber bumper 20 is depressed that allows the clubs to snap and be held in place within each port 13. This snapping holds the clubs prior to being locked and provides a positive feel that each club is correctly in place.

Best seen in FIG. 6, large gear 24 provides an interface between the small gear 14 on the inner locking coupler 14 and metal locking plate 18. By increasing the ratio of the large gear 24 to the small gear 14 on the inner locking coupler 14 the degrees of rotation of the outer locking knob 12 is increased and a greater torque is applied to the metal locking plate 18 thereby making it easier to rotate the metal locking plate 18 in to the locked position.

Cable anchor plate 26 is preferably a metal plate designed in to the lower housing 22 that anchors locking cable 28 to housing 16, 22. Locking cable 28 is a cable with one end attached to the cable anchor plate 26 and the anchor pin 30 attached to the other end as seen in FIG. 3. Anchor pin 30 is a pin configured to fit in to the upper housing 16 through the rubber bumper 20 and through the metal locking plate 18 through aperture 15. It is preferably held in place by means of snapping in to the rubber bumper 20. The loop which is created by placing the anchor pin 30 in the upper housing opening 16 is then locked in place when the metal locking plate 18 is rotated in to the locked position. The initial diameter of the opening for the anchor pin 30 is reduced when the metal locking plate 18 is rotated in to the locked position thereby closing off or locking the anchor pin 30 in to the housing 16, 22.

In operation and use combination golf club lock and golf club holder assembly 8 is a new way of providing club security and protection for golf clubs. Combination golf club lock and golf club holder assembly 8 provides docking stations or ports 9, 11, and 13 that each golf club can snap or insert in to. These individual docking stations hold the clubs by means of a rubber bumper that not only holds the clubs within the lock but also protects the shafts from any abrasion. Once the clubs have been inserted in to these docking stations then the simple rotation of a locking knob 12 rotates locking plate 18 across the opening of these docking stations closing off the openings and locking the clubs within the device. Whereas most golf club locks decrease the size of the openings that the clubs fit in to and squeeze the clubs in a locked position, the present invention maintains the size of the individual opening and merely shuts it off. This allows for the use of assembly 8 as both a golf club lock for security purposes of as a golf club holder and positioning device within a golf bag when the device is not locked.

The circular design of assembly 8 is unique in that it can accommodate most of the slot patterns that are used by golf bags today. This design allows for a generic club configuration and thereby a convenient hand held "easy on/easy off" type of lock that can be used on most golf club bags. In addition, the size and weight combination golf club lock and golf club holder assembly 8 is such that it can be easily carried in the bag stored in the car or other convenient location and used only on an "as needed" basis.

Cable lock 28, cable anchor plate 26, and anchor pin 30 provide a simple, effective means of attaching the lock/clubs system to any convenient location. The locking mechanism does not require additional locking apparatus and is part of and incorporated in to the locking feature of assembly 8.

Additional advantages and modification will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A combination golf club lock and golf club holder assembly, comprising:

an upper housing element having a substantially circular configuration;

an outer locking knob, said outer locking knob being operably coupled to said upper housing element;

an inner locking coupler operably linked to said outer locking knob;

a locking plate, said locking plate being secured to said inner locking coupler; said locking plate being communicatively linked to said outer locking knob by two gears;

a key cylinder, said key cylinder being communicatively linked to said locking plate;

bumper means for holding golf clubs within said combination golf club lock and golf club holder assembly, said bumper means being secured to said locking plate;

cable locking means for locking said combination golf club lock and golf club holder assembly to an object; said cable locking means being secured at one end to a cable anchor plate; and a lower housing element, said lower housing element being configured and adapted to be secured to said upper housing element.

2. The combination golf club lock and golf club holder assembly of claim 1, wherein said cable locking means comprise a cable and a cable anchor pin.

3. The combination golf club lock and golf club holder assembly of claim 1, wherein said outer locking knob is coupled with said inner locking coupler so that when said outer locking knob is rotated it rotates the inner locking coupler.

4. The combination golf club lock and golf club holder assembly of claim 1, wherein said locking plate includes a plurality of apertures sized to receive and secure golf clubs.

5. The combination golf club lock and golf club holder assembly of claim 1, wherein said bumper means is a rubber bumper having a plurality of ports sized to receive and secure golf clubs.

6. A golf club locking device, comprising:

an upper housing element;

an outer locking knob, said outer locking knob being operably coupled to said upper housing element;

an inner locking coupler, said inner locking coupler being substantially circular in configuration, said inner locking coupler being secured to said outer locking knob;

a locking plate secured to said inner locking coupler; said locking plate being communicatively linked to said outer locking knob by two gears.

a key cylinder secured to said locking plate;

a rubber bumper for holding golf clubs within golf club locking device, said rubber bumper being secured to said locking plate;

cable locking means for locking said golf club locking device to a golf bag or other object; said cable locking means being secured at one end to a cable anchor plate; and a substantially circular lower housing element, said lower housing element being configured and adapted to be secured to said upper housing element.

7. The golf club locking device of claim 6, wherein said cable locking means comprise a cable and a cable anchor pin.

8. The golf club locking device of claim 6, wherein said outer locking knob is coupled with said inner locking coupler so that when said outer locking knob is rotated it rotates the inner locking coupler.

9. The golf club locking device of claim 6, wherein said locking plate includes a plurality of apertures sized to receive and secure golf clubs.

10. The golf club locking device of claim 6, wherein said rubber bumper is depressed when a golf club is inserted into one of a plurality of apertures.

* * * * *